United States Patent [19]

Beermann et al.

[11] 4,083,307

[45] Apr. 11, 1978

[54] WATER-TIGHT FIRING CAP ARRANGEMENT AND METHOD OF MAKING THE SAME

[75] Inventors: Paul Beermann; Wilhelm Grosse-Benne, both of Menden, Germany

[73] Assignee: Hagenuk & Co. GmbH, Menden, Germany

[21] Appl. No.: 774,691

[22] Filed: Mar. 7, 1977

[51] Int. Cl.[2] ..... F42B 19/08

[52] U.S. Cl. ..... 102/45; 86/1 R; 102/86.5

[58] Field of Search ..... 102/38, 44, 45, 46, 102/86.5

[56] References Cited

U.S. PATENT DOCUMENTS

| | | | |
|---|---|---|---|
| 2,423,837 | 7/1947 | Martin | 102/86.5 |
| 2,462,135 | 2/1949 | Skinner | 102/46 X |
| 2,708,878 | 5/1955 | Eckstein | 102/86.5 X |
| 2,868,128 | 1/1959 | Ramsey | 102/45 X |
| 2,926,607 | 1/1960 | Muller, Jr. et al. | 102/45 X |
| 3,306,203 | 2/1967 | Schaadt et al. | 102/45 |

FOREIGN PATENT DOCUMENTS

| | | | |
|---|---|---|---|
| 512,285 | 3/1920 | France | 102/45 |
| 875,241 | 8/1961 | United Kingdom | 102/45 |

*Primary Examiner*—Harold Tudor
*Attorney, Agent, or Firm*—Michael J. Striker

[57] ABSTRACT

A firing cap assembly has an interior percussion charge for producing a fire jet along a path in a predetermined direction which extends generally from one side of the assembly towards the other side thereof. The assembly is inserted into a casing having a base wall which extends across the path of the fire jet, and side walls which extend generally along the predetermined direction and which have bendable wall portions at said one side of the assembly. The casing and the assembly mounted therein are both inserted into a cavity of a firing cap carrier having bendable flange portions at said one side of the assembly. The flange portions are bent in direction generally transversely of the predetermined direction to a position in which the wall portions are located intermediate the flange portions and said one side of the assembly so as to form a corner region with said one side of the assembly. Sealing material is thereupon introduced into this corner region so as to prevent access of moisture to the percussion charge located at the interior of the assembly. The water-tight firing cap arrangement is thereby maintained in moisture-proof condition.

11 Claims, 2 Drawing Figures

WATER-TIGHT FIRING CAP ARRANGEMENT AND METHOD OF MAKING THE SAME

BACKGROUND OF THE INVENTION

The present invention generally relates to a firing cap arrangement for igniters and, more particularly, to a water-tight firing cap arrangement and method of making the same.

The igniters for fuses and delay fuses are wellknown in a variety of types. Many of these are so constructed that a user pulls a cord or pin, thereby releasing a firing mechanism which causes a firing pin to forcefully impact against a firing cap. This firing cap detonates, to thereby produce a flame or fire jet which sets fire to the fuse or delay fuse.

Many of these devices have a very complex internal mechanism which makes them not only expensive to produce but also contributes to the possibility of malfunction. More importantly, however, all of these igniters of the prior art have the disadvantage that the capacity for ignition exists only for a limited time, which is essentially the result of the composition of the material of the percussion charge of the firing cap, i.e. the chemical composition of the charge. It is known, for example, to provide firing caps which operate very well but which have a life of only approximately three years, due to the fact that the constituents of the chemical powder composition of the percussion charge are subjected to adverse climatic conditions. It is well known that prolonged and direct exposure to conditions of high moisture, for example due to rain, dew, snow or the like, adversely influences the detonating ability of the charge.

In order to counteract such environmental influences, the firing caps of the prior art are provided with foils and/or adhesive strips at the side at which the fire jet is produced. Such firing caps are also provided with a cover paper for covering a side of the percussion charge.

However, such prior art constructions are disadvantageous because they can only be used with relatively low weight powder and, when such powder is covered by paper, the paper easily detaches therefrom when exposed to water. The attachment and sealing of the foil paper at the flame side of the firing cap is a rather difficult as well as expensive operation which has not proven altogether satisfactory, particularly for military applications.

SUMMARY OF THE INVENTION

It is a general object of this invention to provide an improved igniter for fuses and the like which has a considerably longer lifetime than those known from the prior art, even under extreme climatic conditions.

A further object of the invention is to provide such an igniter wherein the firing cap is water-tightly mounted and which affords high accuracy of ignition of the fuse or delay fuse.

Another object of the invention is to provide a water-tight firing cap arrangement which has a storage life of approximately 10 through 15 years.

In keeping with these objects and others which will become apparent hereinafter, one feature of the invention resides in a water-tight firing cap arrangement and method of making the same which, briefly stated, comprises the steps of providing a firing cap assembly with an interior percussion charge for producing a fire jet along a path in a predetermined direction extending generally from one side of said assembly towards the other side thereof. The assembly is then inserted into a casing having a base wall which extends across the path of the fire jet, and side walls which extend generally along the predetermined direction and which have bendable wall portions at said one side of the assembly. The assembly and the casing are thereupon inserted into a cavity of a firing cap carrier having bendable flange portions at said one side of the assembly. The flange portions are then bent in direction generally transversely of the predetermined direction to a position in which the wall portions are located intermediate the flange portions and said one side of the assembly so as to form a corner region with said one side of the assembly. Sealing material is thereupon introduced into this corner region so as to prevent the access of moisture to the percussion charge located at the interior of the assembly.

In accordance with the invention, the firing cap arrangement is maintained in moisture-proof condition. The present invention provides a water-tight, encapsulated firing cap assembly which is impervious to moisture and other environmental influences for long periods of time, generally on the order of 10–15 years. For the first time, small anvil-type firing cap assemblies, e.g. on the order of 5 mm diameter, with low powder weight are usable in water environments. The construction is relatively simple and inexpensive.

The sealing material can be any elastic deformable synthetic plastic material or sealing lacquer having Butyl- caoutchouc composition or other material having a slight or relatively little water-permeability characteristic.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF THE PREFERRED EMBODIMENTS

Figures 1, 2:
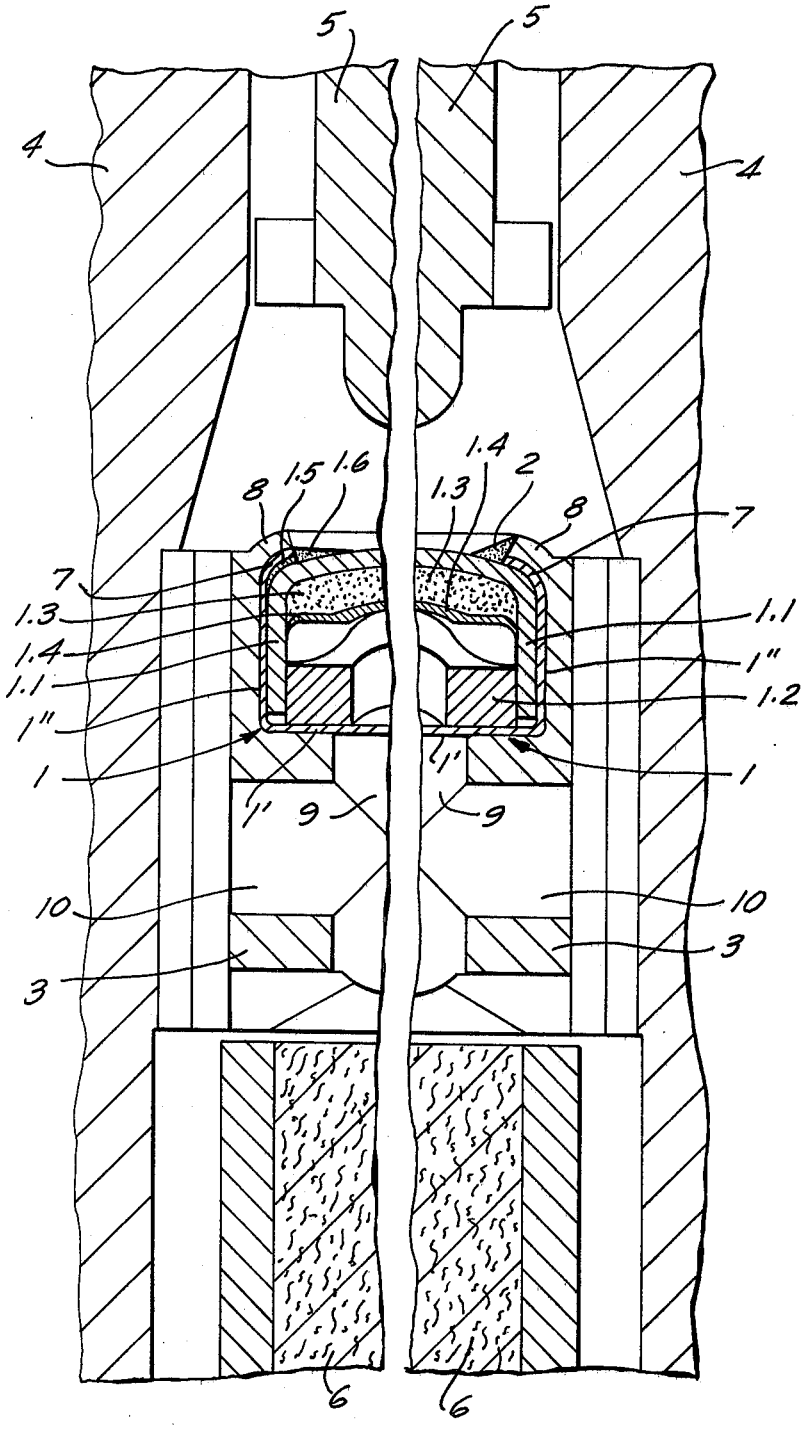
FIG. 1 is a view in axial section of a preferred embodiment of the water-tight firing cap arrangement in accordance with the invention.
FIG. 2 is a view in axial section of another preferred embodiment of the water-tight firing cap arrangement in accordance with the invention.

Discussing jointly the water-tight firing cap arrangement and method of making the same with respect to the drawings, and particularly referring firstly to FIG. 1, it will be seen that reference numeral 4 identifies a housing having an internal bore in which a striker mechanism or firing pin 5 is slidably received. The firing pin 5 is biased towards impacting against an anvil-type firing cap assembly comprised of parts 1.1, 1.2, 1.3, 1.4. Means for biasing the pin 5 for impaction with the firing cap assembly so as to detonate a percussion charge located therein are well known in the art and are not believed to require any further discussion. Details of such arrangements can be found by reference to copending application, Ser. No. 559,159, filed Mar. 17, 1975, by Paul Beermann et al., for "Ignitor for Fuses and the Like," the entire disclosure of which is hereby incorporated by reference.

The firing cap assembly comprises a generally U-shaped shell member 1.1 having an upper closed end and a lower open end. A cover member 1.4 is positioned intermediate these ends and bounds with the closed end an upper first region in which a percussion charge or powder 1.3, such as lead trinitro resorcinate, is located, and also bounds a lower second region with the open end of the shell member. An anvil member 1.2 is located at the open end. In operation, when the firing pin 5 is released for impaction upon the anvil 1.2, the charge 1.3 detonates and produces a fire jet which extends generally in downward direction along a path which extends away from the firing pin 5 towards the fuse 6.

The assembly is mounted into a casing 1 having a base wall 1' which extends transversely across the path of the fire jet. The casing 1 preferably has relatively thin walls as compared, for example, with the shell member 1.1 inasmuch as the fire jet must burn through the base wall 1' to ignite the fuse 6. The casing 1 also has side walls 1'' which are in surface abutting contact with and frictionally engage the shell member 1.1. The side walls 1'' have upper wall portions 7 which are bendable or otherwise deformable, for example by swaging, so as to partially overlie the upper side of the assembly, and particularly the upper side of shell member 1.1.

Both the casing 1 and the assembly mounted therein are inserted into a cavity of a firing cap carrier 3. The carrier 3 has upper flange portions 8 which are likewise bendable or otherwise deformable so as to partially overlie the upper side of the assembly, and particularly the upper side of the wall portions 7.

The wall portions 7 may be bent over the upper side of the assembly before insertion of the casing 1 into the carrier 3. The flange portions 8 are bent over the upper side of the assembly after insertion of the casing 1 into the carrier 3. If the wall portions 7 are not bent over prior to insertion of the casing into the carrier 3, then the bending over of the flange portions 8 will simultaneously and automatically cause the wall portions 7 to bend over due to the more outward location of the flange portions 8.

Sealing means 2, for example any sealing substance, and preferably an adhesive substance, is introduced into a corner region defined between the bent-over portions 7, 8 and the upper side of shell member 1.1. The plug 2 is preferably constituted by moisture-impermeable, heat-resistant material and is operative for preventing access of moisture to the charge 1.3 at the interior of the assembly. In accordance with the invention, the firing cap arrangement is maintained in moisture-proof condition for especially longer periods of time as compared with prior art constructions.

The embodiment of FIG. 2 is essentially analogous to that of FIG. 1 so that like reference numerals have been used to identify like parts. One essential difference is that a foil 1.5 is positioned intermediate the wall portions 7 and the upper side of shell member 1.1 prior to the bending over of the wall portions 7. Also, sealing material 1.6 is introduced into the corner region defined between the upper side of shell member 1.1 and the bendable wall portions 7. The flanging over of the flange portions 8 follows subsequent to the bending over of the wall portions 7 or, as noted above, the flanging over of flange portions 8 occurs simultaneously with the bending over of the wall portions 7.

The casing 1 is preferably constituted by thinwalled aluminum. However, other preferred materials are nitro cellulose, synthetic plastic material, metal material, cardboard material, or any paper material. In the case of aluminum, the thickness of the casing 1, and particularly of the base wall 1', is on the order of 0.1 mm to 0.15 mm. This thickness guarantees that undesirable pressure peaks which result during ignition of the charge are avoided, and further that the flame of the fire jet is reproducable under environmental temperatures ranging anywhere between −40° C to +70° C. Of course, the thickness of the base wall 1' depends in each case upon the strength of the flame of the fire jet, the location of the fuse 6 relative to the firing cap assembly, the powder charge used, whether a delay fuse is used, inter alia. Aluminum is preferred because it is relatively temperature-resistant, impermeable to water, and easily penetrated by the fire jet.

The carrier 3 is also provided with gas-venting openings 10 located laterally of a central bore 9. The bore 9 has a cross-section such that the fire jet originating upon detonation of the firing cap assembly is strongly reduced or braked so that only a small part of the fire jet impinges against the adjacent end of fuse 6. The openings 10 divert and vent the high gas pressure developed during detonation of the firing cap.

It will be understood that each of the elements described above, or two or more together, may also find a useful application in other types of constructions differing from the types described above.

While the invention has been illustrated and described as embodied in a water-tight firing cap arrangement and method of making the same, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. A method of making a water-tight firing cap arrangement, comprising the steps of providing a firing cap assembly having an interior percussion charge for producing a fire jet along a path in a predetermined direction extending generally from one side of said assembly towards the other side thereof an anvil member having two spaced ends one of which faces towards said percussion charge, and a shell member surrounding said percussion charge and said anvil member and having a closed end closing said assembly from said one side thereof; inserting said assembly into a casing having a closed base wall which extends across said path of said fire jet and adjacent to the other end of said anvil member so as to close said assembly from said other end thereof, and side walls which extend generally along said predetermined direction and which have bendable wall portions at said one side of said assembly; inserting said assembly and said casing into a cavity of a firing cap carrier having bendable flange portions at said one side of said assembly; bending said flange portions in direction generally transversely of said predetermined direction to a position in which said wall portions are located intermediate said flange portions and said closed end of said shell member of said assembly so as to form a corner region with the latter; and introducing sealing material into said corner region so as to prevent access of moisture to said percussion charge at the interior of said assembly, whereby said firing cap arrangement is maintained in moisture-proof condition.

2. A method as defined in claim 1, wherein said step of providing said assembly includes forming a shell member into a generally U-shape with an open end and said closed end, positioning a cover member intermediate said open and closed ends of said shell member so as to subdivide the interior of the latter into regions which are bounded by said open end and said closed end, respectively, positioning said anvil member at one of said regions at said open end of said shell member, and filling the other of said regions with said percussion charge which detonates upon impact with said anvile member so as to produce said fire jet.

3. A method as defined in claim 1, wherein said step of inserting said assembly into said casing includes mounting said assembly into frictional engagement with said side walls of said casing.

4. A method as defined in claim 1, wherein said step of bending said flange portions includes the step of simultaneously bending said wall portions; and wherein said step of introducing said sealing material includes contacting said flange portions and said wall portions with said sealing material.

5. A method as defined in claim 1; and further comprising the step of bending said wall portions in direction generally transversely of said predetermined direction prior to the step of bending said flange portions.

6. A method as defined in claim 5; and further comprising the step of positioning a foil intermediate said one side of said assembly and said wall portions prior to said step of bending the latter; and wherein said step of introducing said sealing material includes contacting said foil and said wall portions with said sealing material.

7. A water-tight firing cap arrangement, comprising a firing cap assembly having opposite sides which bound an interior percussion charge for producing a fire jet which extends generally along a path in direction from one of said sides of said assembly towards the other of said sides thereof, an anvil having two spaced ends one of which faces towards said percussion charge, and a shell member surrounding said percussion charge and said anvil member and having a closed end closing said assembly from said one side thereof; a casing partially surrounding said assembly, said casing having a closed base wall which extends transversely across said path of said fire jet, and adjacent to the other end of said anvil member so as to close said assembly from said other side thereof, and side walls which extend generally along said direction and which have transversely-extending wall portions at said one side of said assembly; a firing cap carrier partially surrounding said casing and having transversely-extending flange portions at said one side of said assembly, said flange portions overlying said wall portions and forming with said closed end of said shell member of said assembly a corner region; and a sealing plug in said corner region for preventing access of moisture to said percussion charge at the interior of said assembly, whereby said firing-cap arrangement is maintained in moisture-proof condition.

8. An arrangement as defined in claim 7 wherein said shell-member is generally U-shaped and also has an open end; said firing-cap assembly further comprising a cover member located intermediate said ends of said assembly and bounding with said closed end of said shell member a first region in which said percussion charge is located and also bounding a second region with said open end, said anvil member being located at said second region.

9. An arrangement as defined in claim 7, wherein said shell member has a predetermined thickness, and wherein said casing has a thickness relatively smaller than said predetermined thickness of said shell member.

10. An arrangement as defined in claim 7, wherein said plug is of moisture-impermeable, heat-resistant material.

11. An arrangement as defined in claim 7; and further comprising a foil intermediate said one side of said assembly and said wall portions of said casing.

* * * * *